United States Patent [19]

Merchan

[11] 4,161,793

[45] Jul. 24, 1979

[54] COMBINATION BATHROOM STOOL AND TOILET

[75] Inventor: Mercedes A. Merchan, 6846 Edgemoor, Houston, Tex. 77074

[73] Assignee: Mercedes Merchan, Houston, Tex.

[21] Appl. No.: 886,784

[22] Filed: Mar. 15, 1978

Related U.S. Application Data

[63] Continuation-in-part of Ser. No. 621,023, Nov. 3, 1975, abandoned.

[51] Int. Cl.[2] ..... A47K 11/02; A61G 7/02

[52] U.S. Cl. ..... 4/134

[58] Field of Search ..... 4/134, 167, 111, 112, 4/113, 138, 135, 121, 122, 124

[56] References Cited

U.S. PATENT DOCUMENTS

| | | | |
|---|---|---|---|
| 56,870 | 7/1866 | Alvord | 4/138 X |
| 199,373 | 1/1878 | Kilburn | 4/111 X |
| 881,543 | 3/1908 | Cale | 4/167 |
| 902,449 | 10/1908 | Price | 4/134 |
| 2,146,206 | 2/1939 | Elliott | 4/134 |
| 2,913,732 | 11/1959 | Jones | 4/134 |
| 3,568,219 | 3/1971 | Roberts | 4/134 |
| 3,757,355 | 9/1973 | Allen et al. | 4/110 |
| 3,829,908 | 8/1974 | Thomas | 4/116 |

*Primary Examiner*—Henry K. Artis

[57] ABSTRACT

A stool that includes an upwardly tapered hollow body, a top wall of the body having a central opening so as to serve as a toilet, a removable pot being supported to the underside of the top wall, a pair of opposite handles for pulling or lifting the stool, a removable disc serving to close the top wall opening in order to support a removable cushion thereupon, the cushion being integral with a drape, colorfully decorated, hanging around the side of the stool, doors on a side of the stool providing access to the pot, and also to a compartment for storage of various items, as well as a roll of toilet paper, the stool having retractable casters on its bottom, so that when weighed down by a person, the stool rests upon a rubber rim around its lower edge so as to prevent skidding, and the toilet paper being automatically fed outwardly for use when a person sits upon the stool, so as to be readily available.

5 Claims, 6 Drawing Figures

COMBINATION BATHROOM STOOL AND TOILET

This is a continuation-in-part of my prior application, Ser. No. 621,023, filed Nov. 3, 1975, now abandoned.

This invention relates generally to bathroom stools.

A principal object of the present invention is to provide a novel stool, that can serve also as a toilet, and which accordingly can be used either in a bathroom, or else in a room where a bedridden patient does not have to walk as far to a toilet in a bathroom.

Another object is to provide a combination bathroom stool and toilet, which accordingly is particularly ideal for elderly or handicapped persons, particularly such as may require a toilet very frequently.

Yet another object is to provide a bathroom stool and toilet, which alternately can be used inside a shower stall or in a bathtub, so that a person can sit thereupon, while washing himself completely, or only his feet.

Yet a further object is to provide a combination bathroom stool and toilet, which includes a non-skid construction around its lower edge, as well as retractable coasters, so that the stool is easy to move when needed to be pushed from place to place, and which would remain stationary when sitted thereupon, so that it will not skid.

Yet a further object is to provide a combination bathroom stool and toilet, which includes a compartment for storage of face tissues, rubbing alcohol, and other items convenient to a patient, whether at home or in a nursing home.

Yet a further object is to provide a combination bathroom stool and toilet, in which an end of a toilet tissue roll advances outwardly, for easy grasp, for use when a person sits upon the toilet.

Other objects are to provide a combination bathroom stool and toilet, which is simple in design, inexpensive to manufacture, rugged in construction, easy to use and efficient in operation.

These, and other objects, will be readily evident, upon a study of the following specification, and accompanying drawing, wherein.

Figure 1:
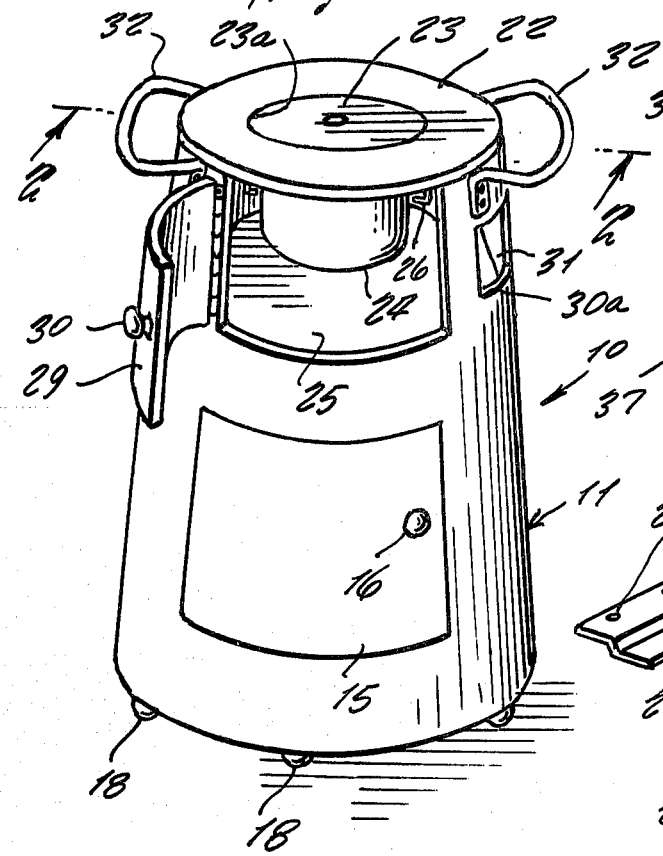
FIG. 1 is a perspective view of the present invention, illustrated with a cushion cover removed therefrom.
Figure 3:
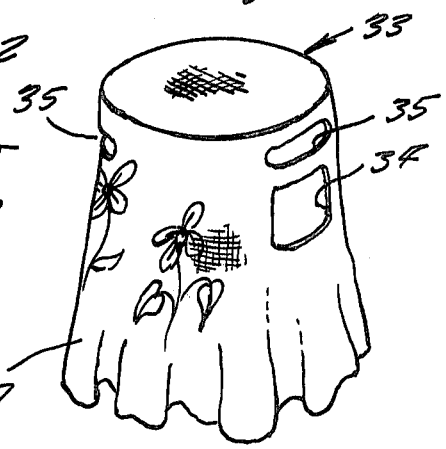
FIG. 3 is a perspective view of the cushion cover removed from the stool.
Figure 4:
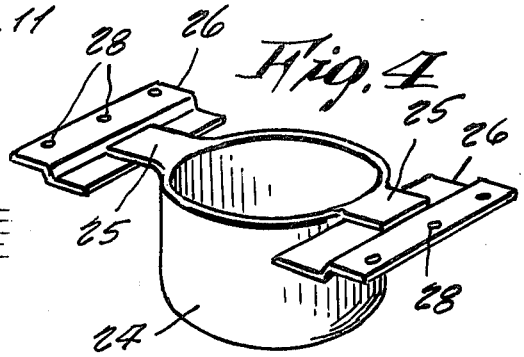
FIG. 4 is a perspective view of a toilet pot and a support therefor.
Figure 2:
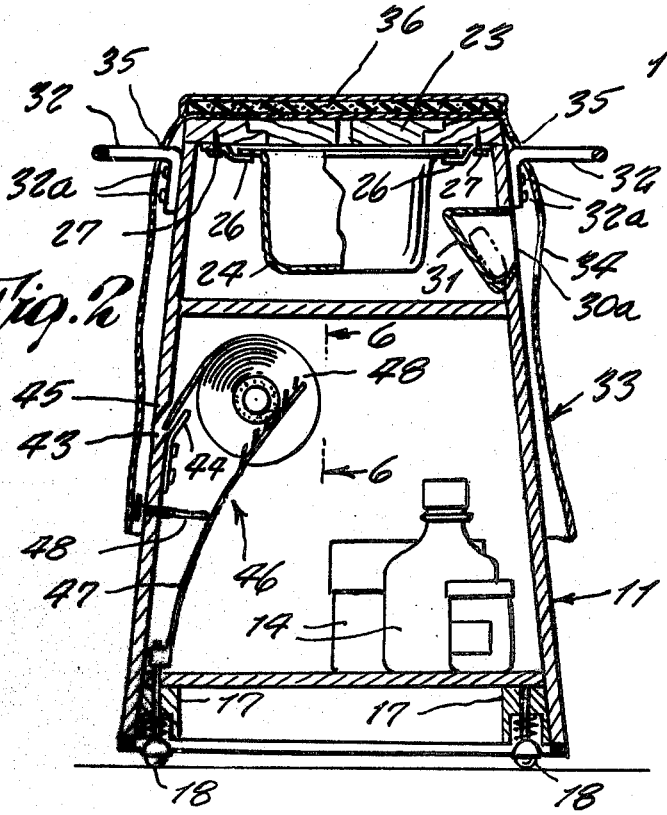
FIG. 2 is a cross sectional view, taken on line 2—2 of FIG. 1.
Figure 6:
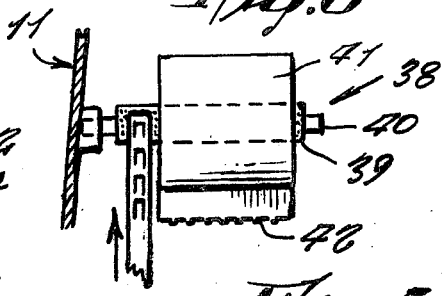
FIG. 6 is a view in direction 6—6 of FIG. 2.
Figure 5:
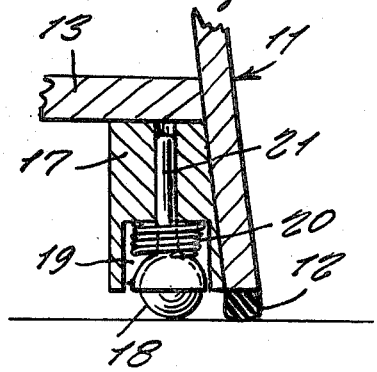
FIG. 5 is an enlarged, detail view of a retractable caster illustrated in FIG. 2.

Referring now to the drawing in greater detail, reference numeral 10 represents a combination bathroom stool and toilet, according to the present invention, wherein there is a hollow and tapered body 11, made either of plastic, wood or the like. A lower edge of the side wall forming the tapered body 11 is fitted with a rubber rim 12, in order to prevent the stool from slipping, when a person is seated thereupon. A bottom inner wall 13 is fixedly secured to the inner periphery of the body 11, so as to provide a storage space for various toiletry articles 14, and which are accessible by means of a hinged door 15 having handle 16.

A plurality of equally spaced-apart blocks 17, secured to an underside of bottom wall 13, each support a retractable caster 18, within an opening 19. A coil compression spring 20, around a shank 21 of the caster, serves to normally urge the caster downwardly below a lower edge of the rubber rim 12, so that the stool is thus adaptable for being rolled from place to place. However, when weight is placed upon the stool, such as by a person sitting thereupon, the spring 20 compresses, so that the rim 12 rests upon the floor, due to the caster becoming upwardly retracted.

A top wall 22 of the stool has a central opening **23*a* therein, and in which is seated a removable disc 23, having a central opening 23*b*, in order to receive a person's finger for lifting the same upwardly. A pot 24, having sidewardly extending ears 25, is slideably supported upon a pair of channel members 26, secured to the underside of top wall 22, by means of fasteners 27 received in openings 28**.

The pot 24 is accessible by means of a hinged door 29, having handle 30. Thus, the pot can be removed, and replaced for use.

An opening **30*a* through the side wall of body 11 provides access to a soap dish 31, secured to the interior wall periphery. A pair of opposite handle grips 32 are secured to opposite sides of the body 11, by means of fasteners 32*a*, the handle grips allowing the device 10** to be lifted, if so desired.

A cover 33 is placed over body 11 in, order to cover the top wall 22 and its central opening with a removable disk 23, the cover also at the same time closing the door 29, so as not to be visible. The cover includes a sponge rubber cushion 36, and a downwardly hanging drape 37. An opening 34 of the cover aligns with the soap dish opening **30*a*, and a pair of openings 35 of the cover enables the handle grips 32** to extend therethrough.

In the present invention, a toilet tissue holder 38 includes a sponge rubber sleeve 39, mounted rotatably free upon a stationary stick 40, secured to the inner side wall of the body. The sleeve 39 frictionally holds, within a central opening, a roll of toilet tissue 41. The leading edge 42 of the toilet tissue roll is pulled outwardly of the stool, through an opening 43 in the side wall of the stool. A guide 44 serves that the leading edge 42 is always within the opening 43, after a portion of the tissue is torn off across a tear edge 45.

In the present invention, the toilet tissue roll is automatically caused to rotate a short distance, and advance the leading edge 42 outwardly of the stool, by means of a mechanism 46, that includes a flexible leaf spring 47, secured at its lower end to one of the caster shanks 21, being provided at its upper end with a row of ratchet teeth 48, for frictionally bearing against the side of the sleeve 39. Thus, when a person sits upon the stool, the upwardly retractable caster causes the mechanism 46 to cause the roll to rotate a short distance, and thus advance the edge 42 outwardly of slot 43, where it can be easily grasped.

When the stool is intended to be used for sitting purposes other than toilet use, the automatic feed of the toilet paper can be arrested by means of a screw 48 being turned, so as to move the leaf spring away from the sleeve 39.

While various changes may be made in the detail construction, it is understood that such changes will be within the spirit and scope of the present invention, as is defined by the appended claims.

What I now claim is:

1. A combination bathroom stool and toilet device, comprising a hollow upwardly tapered body consisting of a frustoconical side wall, a circular top wall and a circular bottom wall, non-skid means upon an underside of said bottom wall for stationarily maintaining said device, caster means on an underside of said bottom wall for moving said device across a floor, a horizontal intermediate wall between said top and said bottom walls defining an upper and a lower chamber within said body, said top wall having a central, circular opening, so as to serve as a toilet seat, a pair of spaced apart channels on an underside of said top wall, a pot below said top wall opening having sidewardly extending ears slideably supported on said channels, an upper doorway on said side wall providing access into said upper chamber for sliding said pot outwardly of said body, said doorway being closeable by a hinged door, a pair of U-shaped handle grips upon opposite sides of said body, an opening in said side wall fitted with an inwardly hollowed soap dish for holding soap, and a removable cushion placed upon said top wall, said cushion being integral with a skirt draped downwardly all around said body and enclosing a major portion of said body from view.

2. The combination as set forth in claim 1, wherein said caster means comprises a plurality of blocks secured to an underside of said bottom wall, each said block having an opening on an underside thereof, a caster supported by each said block being downwardly urged therefrom by a spring, so that said caster protrudes downwardly out of said opening so as to ride upon a floor, said caster being upwardly retracted into said block opening when there is an excessive weight upon said device such as by a person seated upon said top wall or cushion, and said non-skid means comprises a rubber bead secured to an underside of a lower edge of said side wall, said rubber bead engaging said floor when said casters are retracted within said blocks.

3. The combination as set forth in claim 2, wherein a lower doorway through said side wall provides access to said lower chamber, said doorway being closeable by a hinged door, said lower chamber providing storage space for various articles.

4. The combination as set forth in claim 3, wherein said skirt includes a pair of opposite openings for receiving said handle grips outwardly therethrough, and said skirt additionally including an opening aligned with said soap dish for providing access to soap.

5. The combination as set forth in claim 4, wherein one of said retractable casters includes an upwardly shank which at its upper end, said ratchet teeth rolling against a sleeve fitted inside a roll of toilet tissue supported on a horizontal stick, secured to an inner side of said body, a leading edge of said roll extending into a slot through said body sidewall, and means to selectively disengage said leaf spring from said sleeve.

* * * * *